US005503412A

United States Patent [19]

Hill

[11] Patent Number: 5,503,412

[45] Date of Patent: Apr. 2, 1996

[54] MOUNTING PLATFORM FOR SKATING BOOT

[75] Inventor: Martin H. Hill, Syracuse, N.Y.

[73] Assignee: Built For Speed, Inc., Syracuse, N.Y.

[21] Appl. No.: 93,738

[22] Filed: Jul. 20, 1993

[51] Int. Cl.[6] ..... A63C 17/18

[52] U.S. Cl. ..... 280/7.13; 280/11.27; 280/11.3

[58] Field of Search ..... 280/11.16, 11.17, 280/11.18, 11.27, 7.1, 7.13, 7.14, 11.3

[56] References Cited

U.S. PATENT DOCUMENTS

| | | | |
|---|---|---|---|
| 2,904,342 | 9/1959 | Jones et al. | 280/11.16 |
| 4,328,627 | 5/1982 | Sanders | 280/11.27 X |
| 4,332,394 | 6/1982 | Klawitter | 280/11.27 |
| 4,351,536 | 9/1982 | Sandino | 280/11.18 X |
| 5,046,746 | 9/1991 | Gierveld | 280/11.27 X |
| 5,092,614 | 3/1992 | Malewicz | 280/11.27 X |
| 5,340,132 | 8/1994 | Malewicz | 280/11.22 |

*Primary Examiner*—Kenneth R. Rice
*Assistant Examiner*—Michael Mar
*Attorney, Agent, or Firm*—Staas & Halsey

[57] ABSTRACT

A skating boot has an elongated sole portion. Mounting platforms are embedded in fixed positions in the sole portion. The mounting platforms comprise nylon body members. Each body member is provided with a plurality of transversely spaced bolt holes for receiving nut and bolt arrangements for attaching the boot to an ice skate blade or roller skate frame bracket. Each bolt hole includes an enlarged cavity portion for holding a nut or bolt head captive to prevent turning of the latter during assembly. Thus, maximum assembly and/or adjustment flexibility is provided.

7 Claims, 4 Drawing Sheets

MOUNTING PLATFORM FOR SKATING BOOT

BACKGROUND OF THE INVENTION

1. Field of the Invention

The present invention relates to the field of ice skates and roller skates and in particular to components for attaching skating boots to ice skate blades and roller skate frames.

2. Existing Practices and Structures

Prior art boot mounting systems are extremely difficult to adjust, particularly under competitive conditions where split second adjustments are sometimes necessary for peak performance. Common shortcomings of previous attachment systems include assembly and adjustment difficulties, a lack of appropriate adjustment range, the requirement for special custom made parts, and the possibility of disabling an entire skating boot as a result of stripping threads on a nut or bolt component which is affixed permanently to the skating boot.

SUMMARY OF THE INVENTION

The present invention provides a convenient solution for the problems which existed in connection with previously known systems for attaching skating boots to ice skate blades and roller skate frames. In particular, the present invention provides components for attaching an ice skate blade or roller skate frame bracket to a skating boot which facilitates both assembly and adjustment. The invention provides structure for improving the adjustment range of the mounting components. In accordance with the present invention, no special nut and bolt components are required and the components which are included are quickly replaceable in the event of stripped threads. The bolt and the nut both remain movable during the initial stages of installation so as to facilitate assembly. In this regard, either male or female nut and bolt configurations may be utilized for maximum flexibility.

The foregoing improved features are made possible through the use of the present invention which provides a mounting platform for attaching an ice skate blade or roller skate frame bracket to a skating boot. Such skating boots conventionally include an elongated, shaped sole portion having an inner face, an outer face and a longitudinally extending axis. The mounting platform of the present invention preferably, but not necessarily, comprises an elongated main body member having a longitudinally extending axis. The body member may be adapted and configured so that it is conveniently embedded in the sole portion of the boot during the formation of the latter with the axis of the body member extending transversely of the axis of the sole portion.

The body member has an upper surface disposed adjacent the inner face of the sole portion when the body member is embedded in the sole portion. The body member also has a lower surface disposed adjacent the outer face of the sole portion when the body is embedded in the latter. The body member may have three bolt receiving holes which extend therethrough between the surfaces thereof. Each of the holes includes an enlarged upper cavity portion which opens upwardly from the upper surface of the body member, and the holes are spaced apart along the longitudinal axis of the body member. The mounting platform also includes an arrangement including a nut and a bolt for attaching the embedded body member to a skate bracket. The bolt has a head portion and a shank which extends through one of the bolt receiving holes. The arrangement is such that either the nut or the head of the bolt is disposed within the cavity of one of the holes, and such nut or bolt head, as the case may be, is then held captive within the cavity by interaction between the external surfaces of the nut or head and the internal walls of the cavity.

The invention also provides a skating boot assembly. The assembly comprises an elongated boot including a sole portion having inner and outer faces and a longitudinally extending axis. The boot assembly also includes a mounting platform comprising a main body member disposed on the axis of the sole portion. The body member is embedded in a fixed position in the sole portion. The body member has an upper surface disposed adjacent to the inner face of the sole portion and a lower surface disposed adjacent to the outer face of the sole portion.

The body member may be elongated and may be provided with a plurality of bolt receiving holes extending therethrough between the surfaces thereof. In such case the body member will have a longitudinally extending axis which preferably is disposed to extend transversely of the axis of the sole portion. Each of the holes may include a large cavity portion which opens upwardly from the upper surface of the body member, and the holes may be spaced apart along the axis of the body member. The skating boot assembly further comprises an arrangement including a nut and bolt for attaching the assembly to an ice skate blade or roller skate frame bracket. The bolt has a head portion and a shank which extends through one of the holes. The nut or bolt head, as the case may be, is disposed within the cavity of said hole with the nut or bolt head being held captive therein by interaction with the internal walls of the cavity.

As set forth above, in a preferred form of the invention, the body member may be elongated and may have a plurality of bolt holes therethrough. In a strict sense, however, the body member need have only a single bolt hole, in which case the member does not need to be elongated.

In another preferred form of the invention, the body member may comprise a molded nylon structure. In yet another preferred form of the invention, the cavities may have hexagonal cross-sectional configurations. In a more general sense, the nut and head portions should have non-round and/or circumferentially irregular peripheral configurations and the enlarged cavities should have complimentary cross-sectional configurations. Such configurations will prevent turning of the captive component in the cavity when the nut and bolt arrangement is tightened. Preferably, the boot assembly includes a pair of mounting platforms which are spaced apart longitudinally of the first axis.

DETAILED DESCRIPTION OF THE PREFERRED EMBODIMENTS

Figure 1:
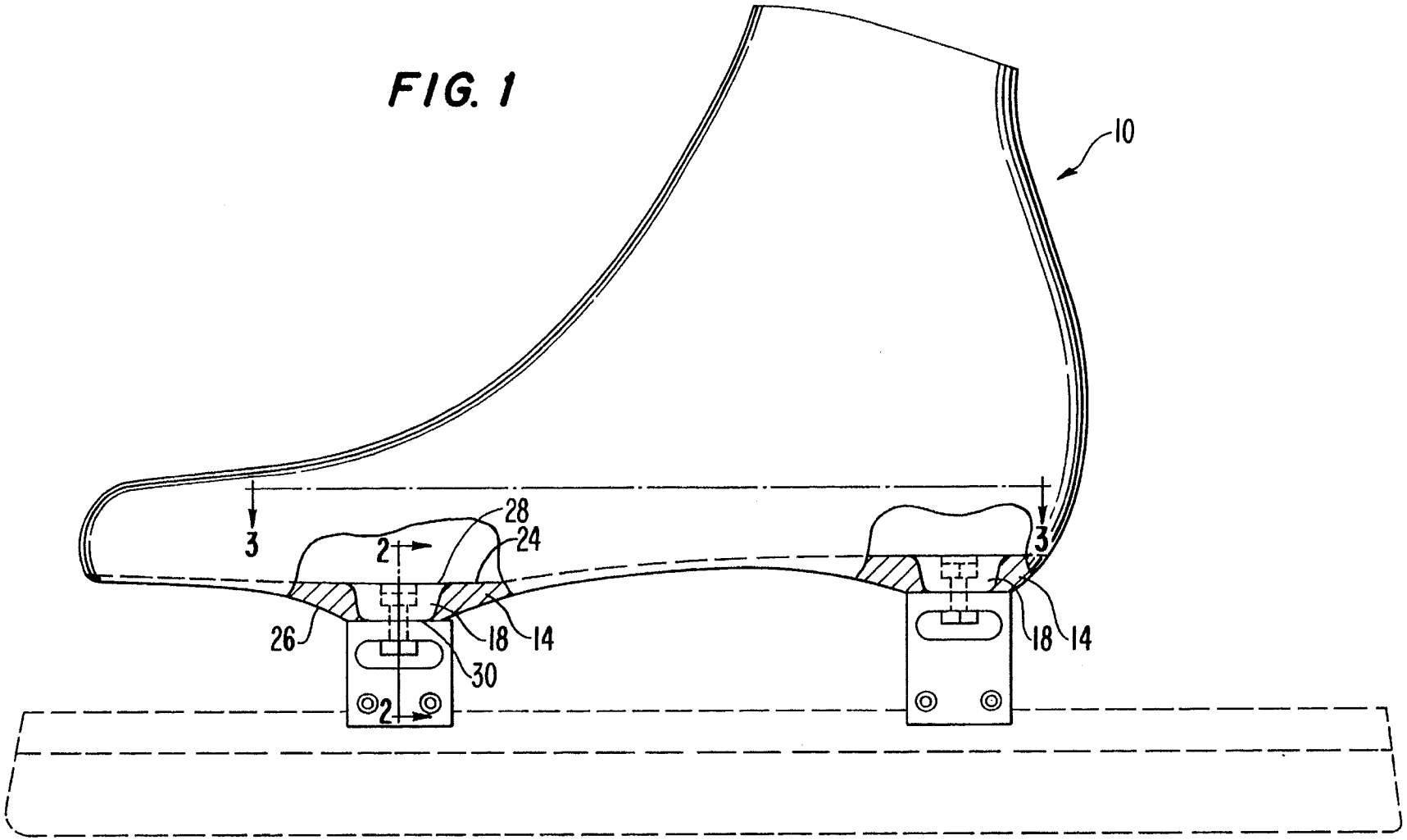
FIG. 1 is a left side elevational view illustrating a skating boot assembly which embodies the concepts and principles of the prevent invention.

A skating boot assembly 10 which embodies the concepts and principles of the present invention is illustrated in FIG. 1 of the drawings. Assembly 10 includes an elongated boot 12 having a sole portion 14.

Figure 9:
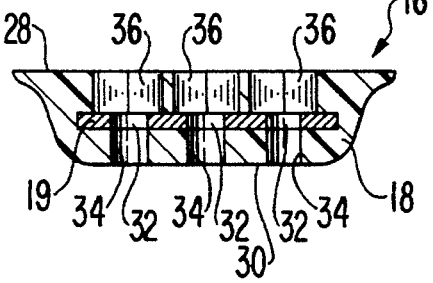
FIG. 9 is a vertical cross-sectional view taken along the line 9—9 of FIG. 8.
Figure 10:
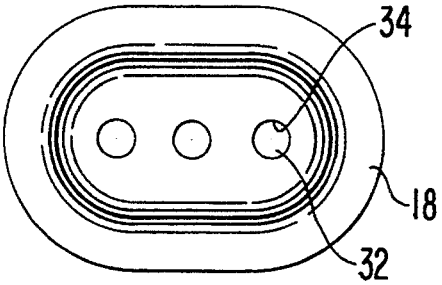
FIG. 10 is a bottom plan view of the platform of FIG. 7.

Assembly 10 includes an elongated mounting platform 16 including an elongated main body member 18 (see FIGS. 7 through 10) which is molded from a nylon, thermoplastic resin material. A metal support and load bearing table 19 is preferably embedded within main body 18, as can be seen in FIG. 9, to provide added support against the forces imposed on platform 18 as a result of skating activities. The actual materials of construction for member 18 are not significant except for the fact that the member 18 must be tough enough to withstand the forces applied thereto during skating activities. Suitable nylon materials are conventionally known and utilized in the construction of mounting components for ice skates and roller skates.

Figure 3:
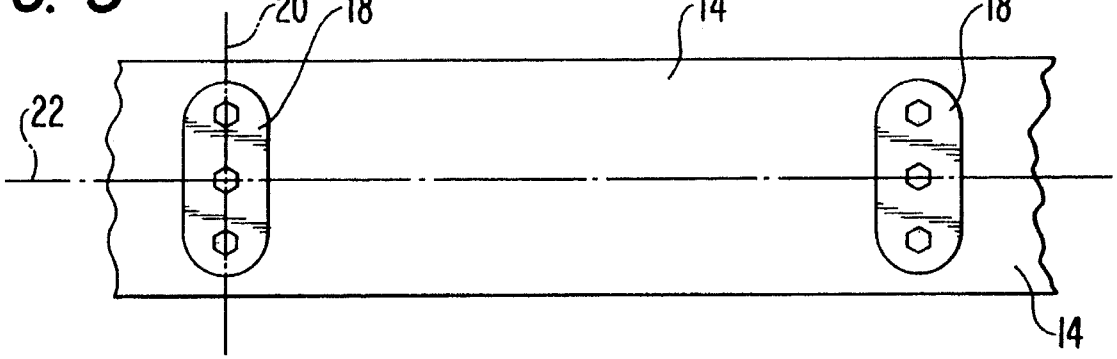
FIG. 3 is a schematic internal plan view of the sole portion of the skating boot taken substantially in the direction of the arrows 3—3 of FIG. 1.
Figure 4:
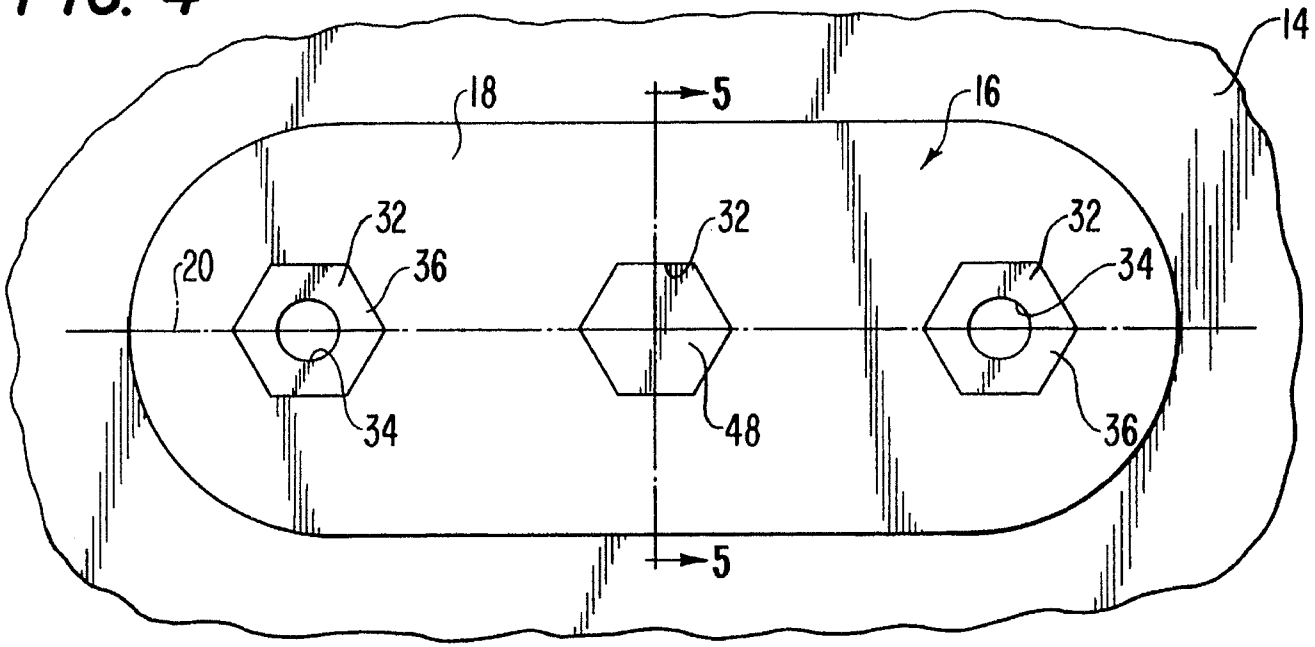
FIG. 4 is an enlarged view of a portion of FIG. 3.

Sole portion 14 may be prepared in a conventional manner utilizing a thermosetting resin filled with a fibrous material to improve its strength and toughness characteristics. Such materials are well known to those skilled in the art of constructing skating boots. Preferably, the body member 18 is embedded in the sole portion 14 during the formation of the latter in such a manner that the body member 18 is held in a fixed position within sole portion 14. After the body member 18 is embedded, the longitudinally axis 20 thereof extends transversely of the longitudinal axis 22 of sole portion 14 (see FIG. 3). It should also be noted from FIGS. 1 and 3, that the skating boot assembly may preferably, although not necessarily, include two of the main body members 18, each of which has been embedded in a fixed position in sole portion 14. Since the main body members 18 are essentially identical, only one of the body members 18 will be further described hereinafter. Suffice it to say at this point that the body members 18 of the elongated boot 12 are spaced apart longitudinally along axis 22 of sole portion 14 as shown schematically in FIG. 3.

Figure 2:
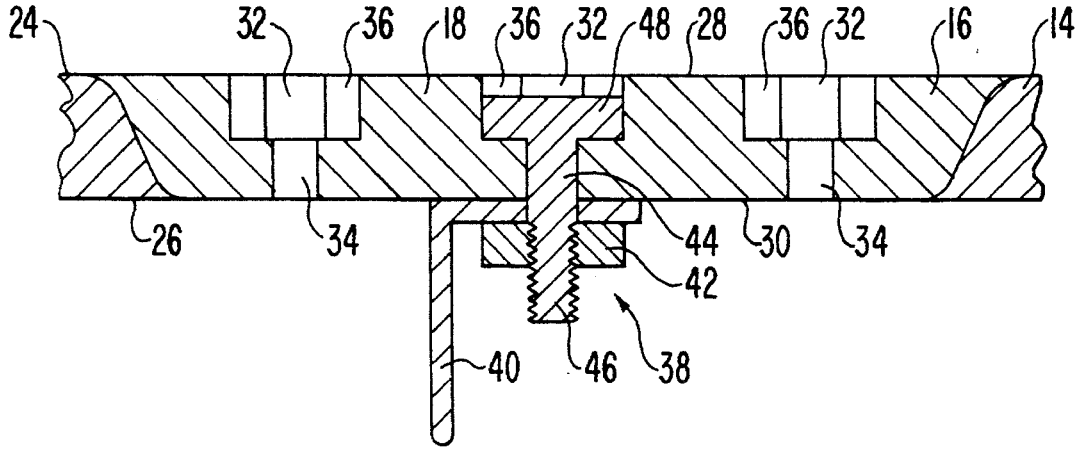
FIG. 2 is a vertical cross-sectional view taken substantially along the line 2—2 of FIG. 1.

With reference to FIGS. 1 and 2, it can be seen that sole portion 14 has an inner face 24 and an outer face 26. Furthermore, body member 18 has an upper surface 28 and a lower surface 30. And with further reference to FIG. 2, it should be noted that the upper surface 28 of member 18 is disposed adjacent the inner face 24 of sole portion 14, whereas the lower surface 30 of the body member 18 is disposed adjacent the outer face 26 of sole portion 14.

As can be seen from the drawings, upper surface 28 of member 18 is somewhat larger than surface 30 thereof, and the peripheral upright walls of the body member 18 have a generally S-shaped configuration so that the member 18 has an overall external shape which approximates the shape of a bath tub.

With reference to FIGS. 2, 4 and 7 through 9, it can be seen that three bolt receiving holes 32 are provided in body member 18. These holes are essentially identical in configuration, and as can be seen from FIGS. 2 and 9, the holes 32 extend entirely through body member 18 between surface 28 and surface 30. Moreover, with regard to FIGS. 4 and 8, it can be seen that the holes 32 are spaced apart along the longitudinal axis 20 of body member 18. Each of the holes 32 includes a lower bolt shank receiving portion 34 and an upper enlarged cavity portion 36 which opens upwardly from upper surface 28 of body member 18.

As described above, the body member 18 is elongated and has three bolt holes 32 therethrough. However, it should be appreciated that only a single bolt hole 32 is required for purposes of the invention, and in that case there is no need for the body member to be elongated. Moreover, the advantages of the invention may be achieved through the use of only a single body member 18 although at the present time most skate designs contemplate both front and rear mounting.

Skating boot assembly 10 includes a nut and bolt arrangement 38 for attaching the boot assembly 10 to a skate bracket 40. The bracket 40 may then in turn be attached to an ice skate blade or roller skate frame. In this regard, reference is made to presently pending and commonly assigned application Ser. No. 08/074,532 filed on Jun. 11, 1993 now abandoned which includes a disclosure of several brackets of the sort which might be utilized in connection with the present invention. Thus, the entirety of the disclosure of said '532 application is specifically incorporated herein by reference thereto. Additionally, it should be noted that the present invention is not dependent upon the exact shape and form of the skating bracket, and in fact the present invention provides flexibility of assembly and adjustment for all conventionally known bracket arrangements.

Figure 7:
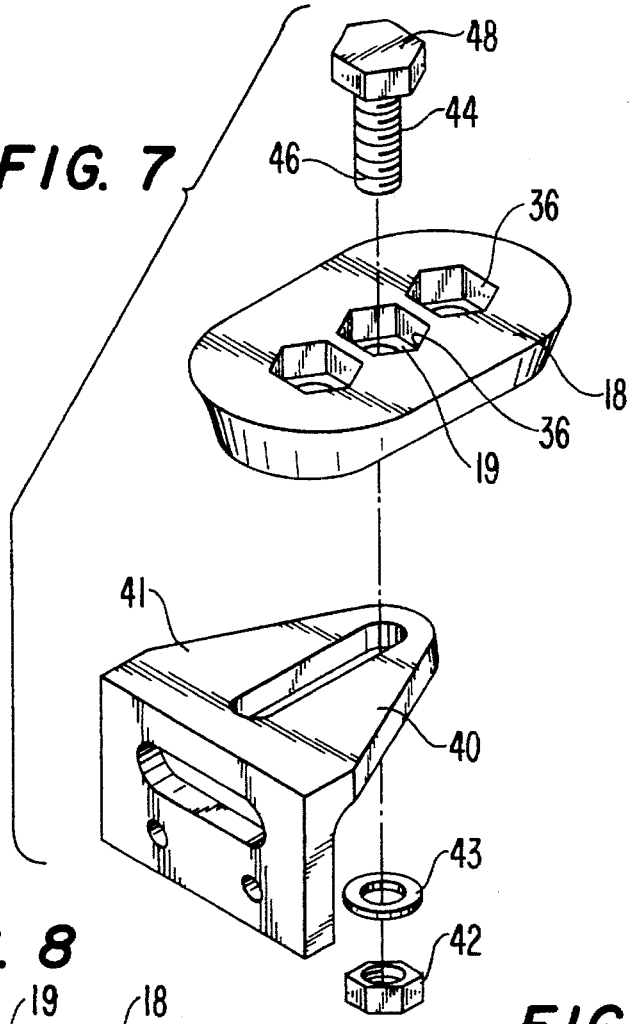
FIG. 7 is an exploded perspective view illustrating the interrelationship of the platform, the bracket and the nut and bolt assembly of FIG. 1.
Figure 8:
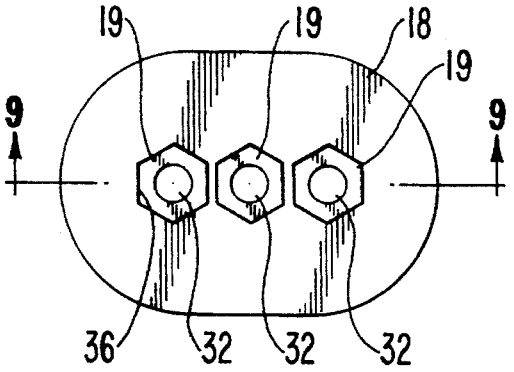
FIG. 8 is a top plan view of the platform of FIG. 7.

Nut and bolt arrangement 38 includes a nut 42 and a bolt 44. Bolt 44 has a shank 46 and a head 48. As can be seen viewing FIGS. 4, 7 and 8, cavity portion 36 preferably has a hexagonally shaped horizontal cross-sectional configuration. Similarly, head 48 of bolt 44 is hexagonally shaped so that the same may be snugly received within cavity portion 36. Thus, head 48 is prevented from rotating as nut 42 is tightened onto shank 46. In this regard, it should simply be noted in passing that nut 42 and shank portion 46 include conventional threads so that the nut 42 is threadably received on shank 46. In addition, as is illustrated in FIG. 7, a washer 43 may be utilized if desired. And as is conventionally known, washer 43 may be a locking type of washer.

Figure 5:
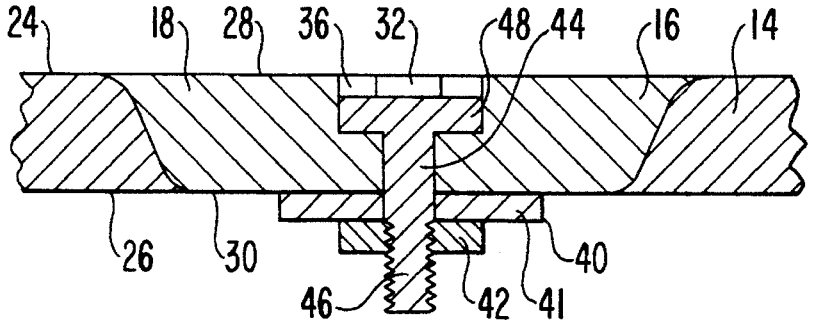
FIG. 5 is a vertical cross-sectional view taken substantially along the line 5—5 of FIG. 4.
Figure 6:
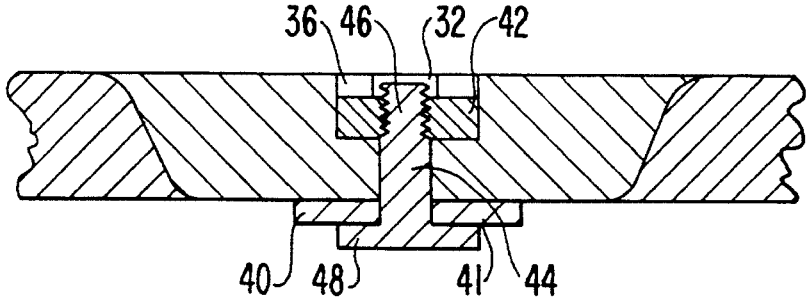
FIG. 6 is a view similar to FIG. 5 showing an alternative nut and bolt arrangement.

With reference to FIG. 6, it can be seen that the nut 42 and the bolt 44 may be installed in a reverse configuration. In this case, the nut 42 preferably has a hexagonal shape so that the same may be held against rotation within the cavity portion 32. Rotation of nut 42 is thus prevented during tightening of bolt 44. FIG. 5 is conventionally referred to as a male configuration, where the threaded portion 46 of the bolt 44 protrudes on the outside of the boot. Conversely, the configuration of FIG. 6 is referred to commonly as a female configuration, in which case the shank portion 46 of bolt 44 extends through the mounting plate 41 of the bracket 40, then through the bottom side of the boot, and the same is screwed into the captive hex nut 42 located in cavity 36.

In FIG. 5, the bolt head 48, and in FIG. 6, the nut 42, should have non-round or circumferentially irregular peripheral configurations. Likewise, the cavity 36 should have a complimentary non-round or circumferentially irregular cross-sectional configuration. Thus, in the case of FIG. 5, the head 48, and in the case of FIG. 6, the nut 42, will be held captive in the cavity portion 36 by interaction of the external surfaces of the bolt head or the nut, as the case may be, with the internal surfaces of cavity 36. Tightening of the nut and bolt arrangement is thereby facilitated.

As can be seen, all threaded parts which are susceptible of stripping or other damage are conveniently user-replaceable. Moreover, as can readily be appreciated, conventional, readily obtainable hardware store parts may be utilized. Additionally, maximum flexibility is provided by the present invention whereby either the male configuration of FIG. 5 or the female configuration of FIG. 6 may be utilized to facilitate assembly. Such flexibility is particularly useful if the attachment frame interferes with access to the outside of the skate boot. In this connection, it should also be noted that a socket head cap screw may be utilized instead of the hex bolt. Such cap screws have a round head which provides an interference or frictional fit within the cavity 36 sufficient to prevent turning of the bolt during normal skating activities. Such components permit turning of the screw when force is applied through the use of a tool such as an Allen wrench.

In any of the cases described above, the enlarged cavity portion 36 is utilized to hold captive either the nut (in the female configuration) or the bolt head (in the male configuration). In this manner, the inside end of the nut and bolt assembly is prevented from turning while the user applies a wrench to the other end to secure a blade or roller frame to the boot.

I claim:

1. A mounting platform for attaching a roller skate frame or an ice skate blade bracket to a skating boot, said boot including an elongated sole portion having an inner face, an outer face and a longitudinally extending first axis, said mounting platform comprising:

a main body member which is adapted and configured for being embedded in a said boot sole portion on said first axis, said body member having an upper surface which is intended for being disposed adjacent the inner face of the sole portion and a lower surface which is intended for being disposed adjacent the outer face of the sole portion when the body member is embedded in said sole portion, said body member being provided with at least one bolt receiving hole extending therethrough between said surfaces, said hole including an upper enlarged cavity portion which opens upwardly from said upper surface and a lower bolt shank receiving bore portion, said hole being disposed on said first axis; and an arrangement including a nut and a bolt for attaching an embedded body member to a skate bracket, said bolt having a head portion and a shank extending through said hole, one of said nut and said head portion being disposed within the cavity of said hole with the other one of said nut and said head portion held captive against rotation therein by interaction with the internal walls of the cavity, said body member being elongated and having a second axis extending therealong, said body member having a plurality of holes therein extending therethrough, said holes being spaced apart along said second axis, said second axis being disposed to extend transversely of said first axis.

2. A skating boot assembly comprising:

an elongated boot including a sole portion having inner and outer faces and a longitudinally extending first axis;

an elongated mounting platform comprising a main body member having a second axis extending therealong, said body member being embedded in a fixed position in said sole portion with said second axis extending transversely of said first axis, said body member having an upper surface disposed adjacent the inner face of the sole portion and a lower surface disposed adjacent the outer face of the sole portion, said body member being provided with a plurality of bolt receiving holes extending therethrough between said surfaces, each of said holes including an enlarged cavity portion which opens upwardly from said upper surface, said holes being spaced apart along said second axis; and an arrangement including a nut and a bolt for attaching said assembly to an ice skate blade or roller skate frame bracket, said bolt having a head portion and a shank extending through one of said holes, one of said nut and said head portion being disposed within the cavity of said one of said holes with the other one of said nut and said head portion held captive therein by interaction with the internal walls of the cavity.

3. A boot assembly as set forth in claim 2, wherein said body member comprises a molded plastic member.

4. A boot assembly as set forth in claim 2, wherein said cavities have hexagonal cross-sectional configurations.

5. A boot assembly as set forth in claim 2, wherein said nut and said head portion have non-round or circumferentially offset peripheral configurations and said cavities have complimentary cross-sectional configurations.

6. A boot assembly as set forth in claim 2, wherein said assembly includes a pair of said mounting platforms spaced longitudinally of said first axis.

7. A boot assembly as set forth in claim 2, wherein said member has at least three of said bolt receiving holes extending therethrough.

* * * * *